US005135099A

United States Patent [19]

Ehrenreich et al.

[11] Patent Number: 5,135,099

[45] Date of Patent: Aug. 4, 1992

[54] TRANSPORT DEVICE

[75] Inventors: Ralf Ehrenreich, Germeringen; Josef Hafner, Landsberg/Lech, both of Fed. Rep. of Germany

[73] Assignee: RSL Logistik GmbH & Co., Landsberg/Lech., Fed. Rep. of Germany

[21] Appl. No.: 657,865

[22] Filed: Feb. 20, 1991

[30] Foreign Application Priority Data

Feb. 21, 1990 [DE] Fed. Rep. of Germany ..... 9002071

[51] Int. Cl.[5] ..... B65G 47/46

[52] U.S. Cl. ..... 198/349

[58] Field of Search ..... 198/349

[56] References Cited

U.S. PATENT DOCUMENTS

| | | | |
|---|---|---|---|
| 3,530,571 | 9/1970 | Perry | 198/349 X |
| 3,560,073 | 2/1971 | Knapp | 198/349 X |
| 3,581,704 | 6/1971 | Connell | 198/349 X |
| 3,627,153 | 12/1971 | Brummett et al. | 198/349 X |
| 3,949,192 | 4/1976 | Kuwertz et al. | 198/349 X |
| 3,952,388 | 4/1976 | Hasegawa et al. | 198/349 X |
| 4,227,613 | 10/1980 | Seitz | 198/349 X |
| 4,597,495 | 7/1986 | Knosby | 198/349 X |

FOREIGN PATENT DOCUMENTS

| | | |
|---|---|---|
| A3628045 | 5/1987 | Fed. Rep. of Germany . |
| A3822800 | 1/1990 | Fed. Rep. of Germany . |

*Primary Examiner*—D. Glenn Dayoan

*Attorney, Agent, or Firm*—Finnegan, Henderson, Farabow, Garrett & Dunner

[57] ABSTRACT

A transport device for bobbins, in particular for a suspension conveying system having tracks is described, which device includes a transport body support for holding a plurality of bobbins and track rollers for rolling on tracks. A coding device for the bobbins is disposed on the movable transport body support and is engageable with a fixed code setting device on the track to facilitate coding and handling of the bobbins in a constructionally simple fashion by providing a settable coding common to several bobbins.

11 Claims, 3 Drawing Sheets

TRANSPORT DEVICE

BACKGROUND OF THE INVENTION

1. Field of the Invention

The invention relates to a transport method and device of the type having a suspension conveying means including a transport means and track rollers for rolling on tracks, for conveying a plurality of bobbins.

2. Descriptions of the Prior Art

It is necessary in spinning mills to mark the yarn contained on the bobbins according to quality and/or processing step, since different qualities and difference process steps cannot always be detected by visual inspection of the yarn itself. At present, different-colored tubes are used for this purpose, each tube color marking a specific quality and/or a specific processing step. However, it is not always easy to determine the required number of the colored tubes in advance and to keep them in stock. Moreover, automating the production process using the colored tubes is extremely complex, since the respective requirements of tubes of a specific color would have to be ascertained in time prior to the beginning of a process step and the required number must be supplied from the stock of bobbins.

SUMMARY OF THE INVENTION

Thus, the invention is based on the object of creating a transport method and means for the bobbins which permits a sufficient and telling marking of the bobbins in a constructionally simple fashion and with reduced work load.

The object is accomplished by providing means for grouping on the transport means bobbins having the same quality and/or requiring the same next processing step, and disposing on the transport means, a settable coding means common to the several bobbins.

The invention starts from the consideration that bobbins which are jointly disposed on a transport means must be conveyed by the same processing machine to the same processing machine of the subsequent process step.

Due to the combination of the bobbins in groups, a constructionally substantially less complicated coding means is possible. The less complicated coding means can moreover be disposed on the transport means in such fashion that the production and work expenditure for the coding can be reduced. The coding means of the present invention can moreover only be effected if all bobbins to be accommodated on the transport means have already passed the process step so that automation of the coding or of the entire production process is possible in a relatively simple fashion.

A transport means with an especially preferred coding means includes a code support with a plurality of code signatures, and marking means for setting code signatures. The coding means according to the invention is of an extremely simple handling and can be set both in automated fashion and manually by unskilled persons (e.g. in the case of failures in the automatic operation).

Advantageous further developments of the transport means according to the invention are revealed by the accompanying drawings and descriptions.

An example of an embodiment of the invention is explained in greater detail in the following by means of the drawings.

DESCRIPTION OF THE PREFERRED EMBODIMENT

Figure 1:
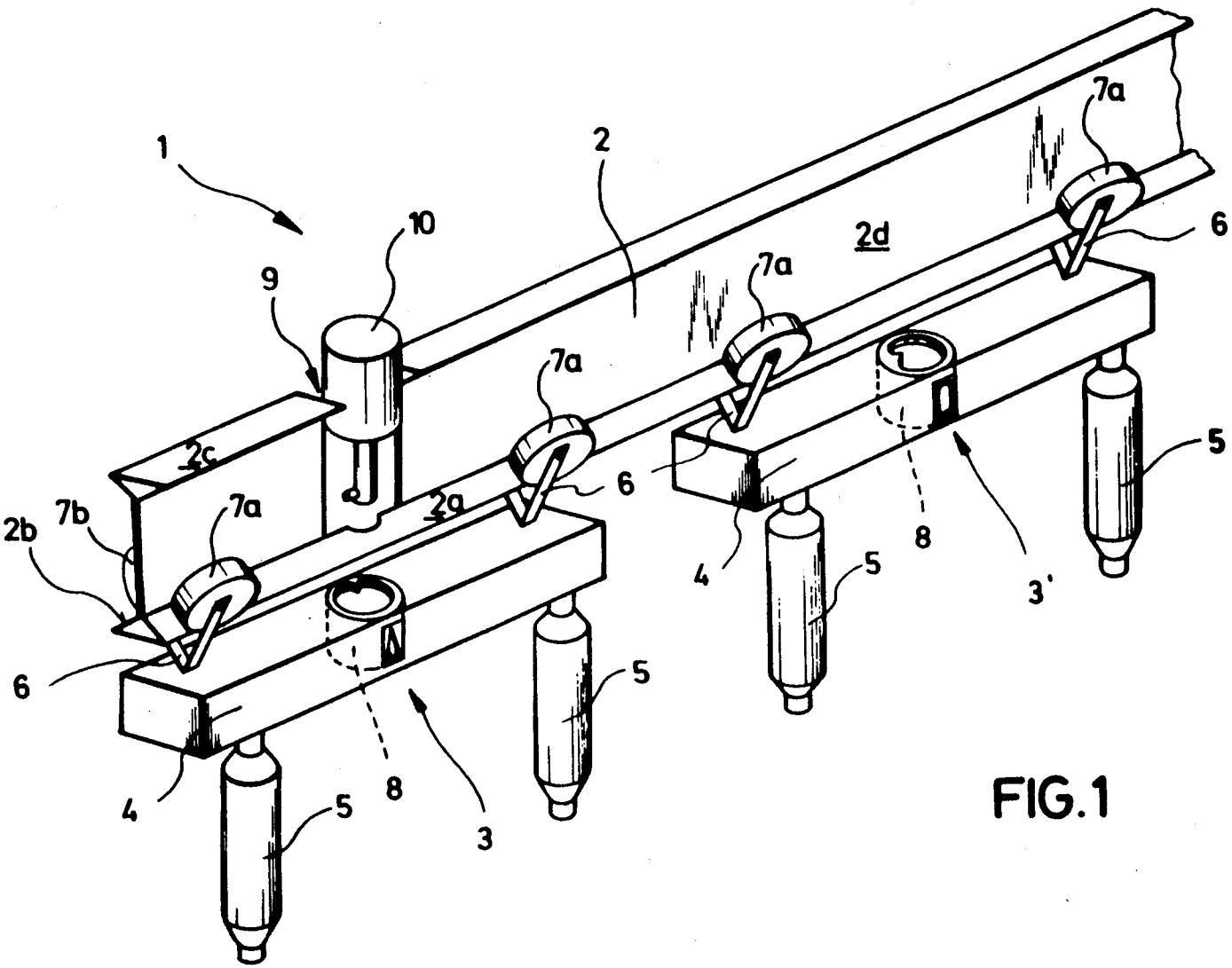
FIG. 1 shows a schematic, perspective representation of a transport device according to the invention.

A transport device designed as suspension conveying system is shown in FIG. 1, a piece of a track 2 of it being shown which comprises two running surfaces 2*a* and 2*b* disposed at an angle to each other, a fastening flange 2*c* and a track web 2*d* connecting the fastening flange 2*c* with the running surfaces 2*a*, 2*b*.

Two identically designed transport means 3, 3' are suspended at the track 2 in the representated part of the transport device 1. The transport means 3, 3' can be coupled with each other, if required, by coupling hooks (not shown) to a jointly movable train.

Each transport means 3, 3' has an oblong support 4, on which a plurality of bobbins 5 are suspended in each case by means of commercially available unmarked supports, only two bobbins 5 each are drawn per support for reasons of clearness. A strap 6 each is fastened to each end of the support 4, on which two track rollers 7*a*, 7*b* are rotatably mounted for rolling on the running surfaces 2*a*, 2*b* of the track 2.

A mechanically settable coding means 8 which is only schematically outlined is accommodated within each support 4. The track 2 includes a recess at one or several suited points within the transport device, e.g. at a point where the transport means 3 are loaded with bobbins 5. A setting means 10 is accommodated for setting the coding means 8.

Figure 2:
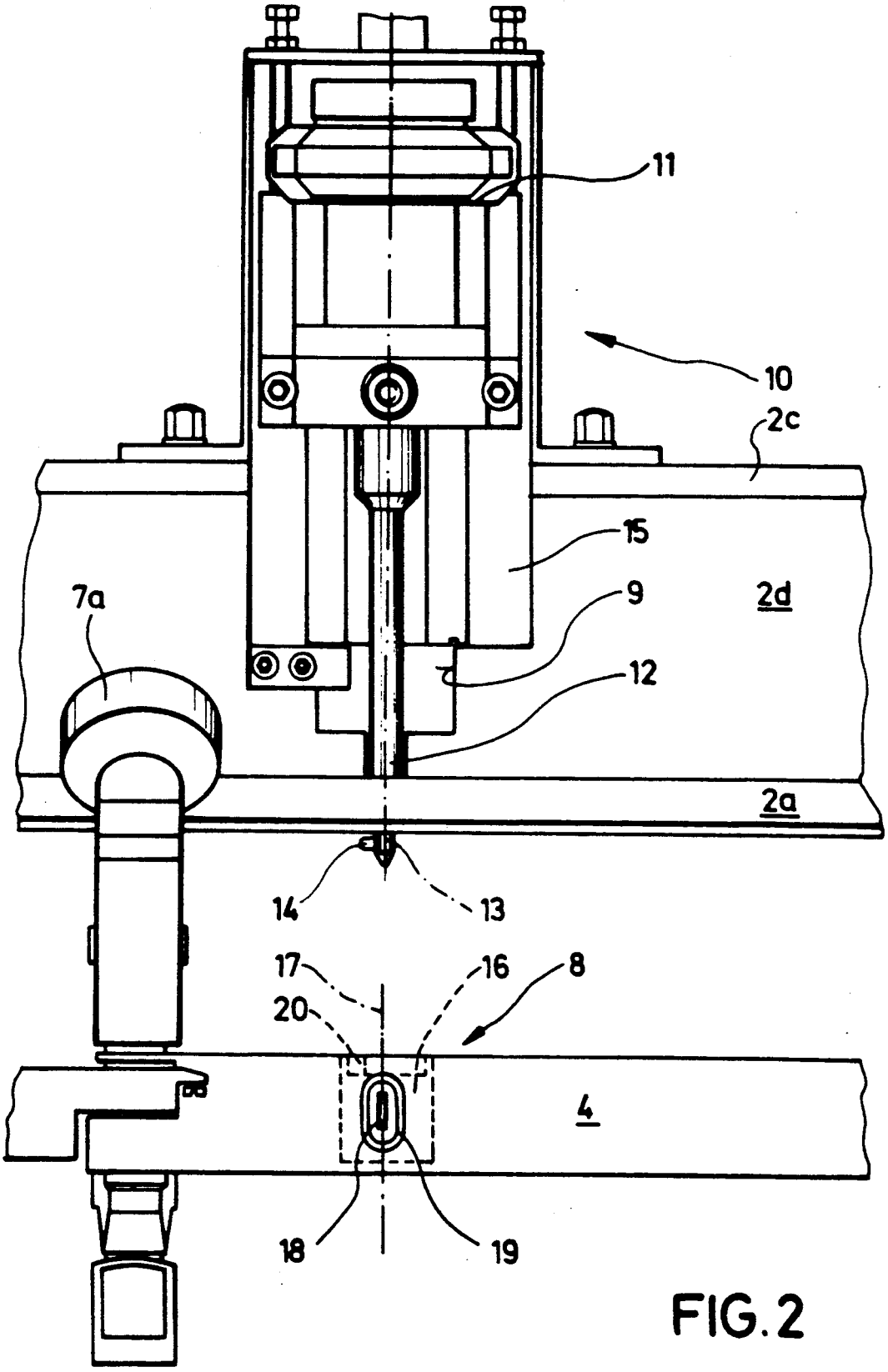
FIG. 2 shows a lateral view of the coding means and the code setting means.
Figure 3:
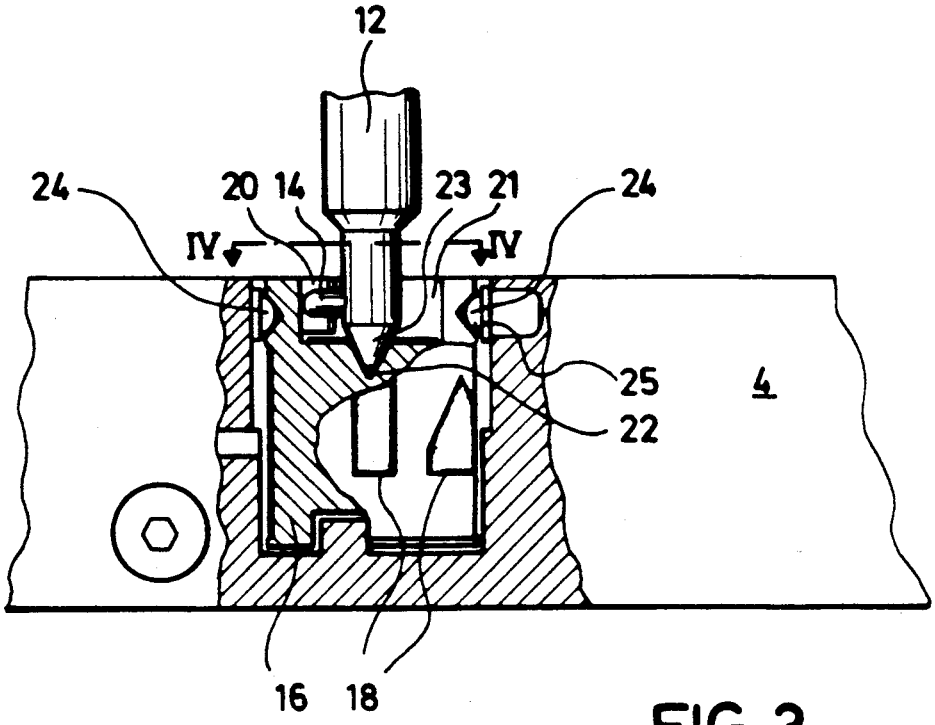
FIG. 3 shows an enlarged detail with the code setting means in engagement and FIG. 4 shows the section IV—IV of FIG. 3.
Figure 4:
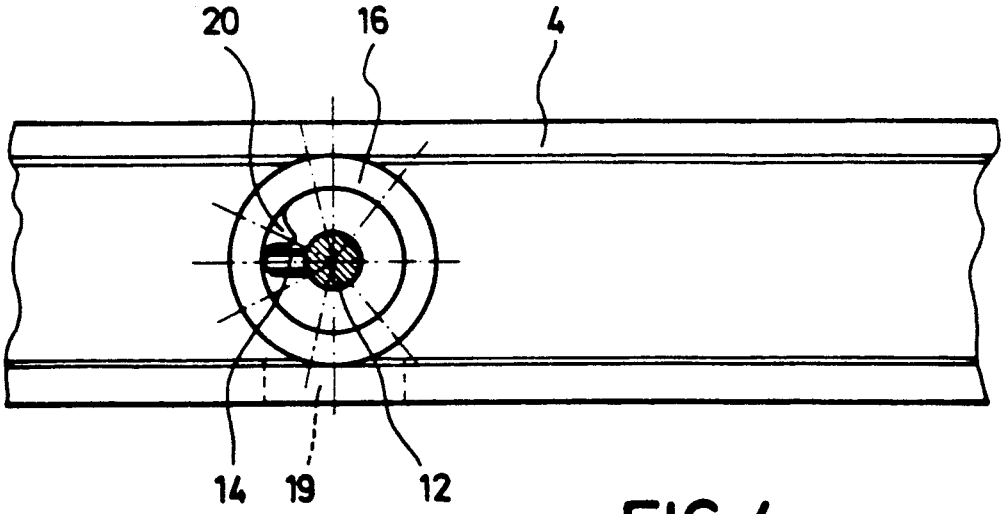

The coding means 8 and the setting means 10 are represented in greater detail in FIGS. 2 to 4. The setting means 10 contains a commercially available, pneumatic pivoting drive 11, with which a pin 12 can be rotated about an axis of rotation 13 in angular steps which steps can be adjusted in advance and changed in their size. A laterally projecting setting finger 14 is fastened to the free end of the pin 12. The pivoting drive 11, the pin 12 and the setting finger 14, are slidingly mounted, again pneumatically, in a slideway 15 in the direction of the axis of rotation 13, which is fastened in the recess 9 of the track 2. The slideway 15 is disposed in such fashion that the pin 12 with the setting finger 14 can be lowered into the path of the coding means, if the transport means 3 is moved into the coding position on the track 2.

The coding means 8 contains a code support 16 which is designed as a cylinder, disposed in the interior of the support 4, and mounted rotatably about an axis 17. The axis of rotation 17 of the code support 16 extends substantially in the vertical direction. The circumferential surface of the cylinder 16 is provided with a plurality of visually identifiable code signatures 18, such as different color fields or different symbols. A marking means 19 in the form of a window pointing laterally is provided in the support 4, through which one of the code signatures 18 is visible in each case. If the cylinder 16 is rotated about the axis of rotation 17, the different code signatures can appear successively in the window 19.

As best seen in FIG. 3, a lug 20 is provided on an upwardly pointing front surface of the cylinder 17 to set the coding means. Lug 20 can either be seized with the fingers for manual setting, or, as is shown by FIGS. 3 and 4 serves as a stop for the setting finger 14. The cylinder 16 includes a recess 21 with a central centering cavity 22 on includes a recess 21 with a central centering cavity 22 on its front surface oriented in the direction of the setting means 10, into which a centering tip 23 of the pin 12 fits. The lug 20 is disposed in the recess 21 so that it cannot be set unintentionally. Spring-located locking balls 24 are provided for the further securing against an unintentional setting. Locking both 24 are disposed on the support 4 and engage fitting locking recesses 25 on the cylinder 16. The locking recesses 25 are distributed at equal distances about the circumference of the cylinder 16 corresponding to the code signatures 18.

To set the coding, one of the transport means 3, 3' is in first moved in under the setting means 10 coding, so that the axis of rotation 13 and 17 are aligned coaxially to each other. Then the pivoting drive 11 with the pin 12 and the setting finger 14 is moved downwardly until the centering tip 23 is immersed into the centering cavity 22. Then the rotational drive of the pin 12 is actuated until the setting finger 14 rests against the stop surface of the lug 20, which faces it. If the setting finger 14 is further rotated by predetermined angular steps, each of the desired code signatures 18 can be rotated into view through the window 19. After this is done the pivoting drive 11 is again moved into its inactive position shown in FIG. 2.

Coding means with other geometrical configurations such as rotatable balls, rotatably driven bands, pivoting cubs or the like can e.g. be used in place of the described and drawn cylindrical embodiment. It is likewise possible in kinematic reversal to design the marking means as a slide and to dispose the code support fixedly on the transport means. The coding means can moreover also be accommodated in other suitable parts of the transport means, not only on the support. The setting means can be driven electrically or in any other fashion instead of being driven as shown in the Figures. The coding means and the setting means can be configured in such fashion that setting of the coding can be carried out during the run. This is e.g. possible by means of a gearwheel attached to the rotatably mounted code support and a toothed rack which can engage and advance to the toothed wheel, if required, or by means of cams disposed on the rotatable code support and representing in each case a code signature, and cam pins which can be introduced into the path of this cam at predetermined points.

If it should be possible to read the coding from below or from above, the arrangement of the axes of rotation of the code support 16 and setting means 10 can be correspondingly changed. The code support can also comprise a plurality of different optically readable bar codes instead of visually identifiable code signatures such as color, shape, figures, letters or the like. Bar code readers or color recognition sensors can be used for automated recognition. Also the setting means can be disposed at other positions, e.g. they can be mounted laterally into the transport means, for instance in the case of a deviating track cross-section. It is furthermore possible to provide two or still more coding means per transport means. Two coding means pointing to different sides and/or disposed on the front and rear ends of the transport means can e.g. be provided. The coding means of a transport means can show the same code signatures for recognizing different locations and/or different code signatures to convey a plurality of pieces of information.

We claim:

1. A method of conveying bobbins on an overhead conveying system having tracks, by transport means having track rollers for rolling on the tracks, the method comprising the steps of: grouping said bobbins into a plurality of groups, each of said groups including bobbins of yarn of the same quality or bobbins subjected to a common processing step; attaching each group of bobbins to its own transport means, said transport means having a coding means adapted to be set manually or automatically, said coding means including a plurality of coding signatures and marking means; setting said coding means in accordance with the quality of yarn or with the processing step by manually or automatically moving said code signature relative to said marking means; and conveying said transporting means along said tracks in accordance with said set coding means.

2. A transport device for bobbins for use with overhead conveying means including tracks, the device comprising: a transport means for holding a plurality of bobbins, said transport means having track rollers for rolling on the tracks; coding means connected to said transport means; and a code setting device fixed relative to said transport means, said coding means including a code support with a plurality of signatures and also including marking means for selectively displaying said code signatures, said coding support and said marking means being movable relative to each other, wherein said coding means further includes means comprising a stop surface for setting the coding and wherein said code setting device includes a setting finger, said stop surface being adapted to be engaged by fingers of a user and by said setting finger of said setting device for setting a predetermined coding alternatively manually or automatically by effecting relative movement between said code support and said marking means said setting finger being automatically selectively movable into and out of the path of said stop surface of said code support.

3. The transport device according to claim 2, wherein said transport means includes a bobbin support and the coding means is disposed on said support, said support connected to the track rollers.

4. The transport device according to claim 2, wherein the setting device is disposed on the track.

5. The transport device according to claim 2, wherein the coding means contains visually identifiable code signatures.

6. The transport device according to claim 2, wherein the code support is a rotational element being rotatable about an axis of rotation and on whose circumferential surface is provided the code signatures.

7. The transport device according to claim 2, wherein the code support is disposed in the interior of the bobbin support and the marking means is a window aperture in the support.

8. The transport device according to claim 2, wherein the code support is a cylinder rotatable about a substantially vertical axis of rotation and having an upwardly facing front surface, said stop surface being provided on said front surface, and wherein the setting finger is rotatable about an axis of rotation extending coaxially to the axis of rotation.

9. The transport device according to claim 2, wherein the code setting device is automatically controllable.

10. The transport device according to claim 2, wherein said stop surface comprises a lug.

11. The transport device according to claim 2, wherein said transport means includes an oblong support, the track rollers being mounted on said oblong support, and said oblong support supporting the bobbins, wherein a pair of coding means are provided one at each respective end of said oblong support whereby the code setting of said oblong support is recognizable when viewed from different directions.

* * * * *